United States Patent [19]

Childeric

[11] 4,131,718

[45] Dec. 26, 1978

[54] ROTATING ANODE FOR X-RAY TUBE

[75] Inventor: Bruno Childeric, Grenoble, France

[73] Assignee: Eurotungstene, Grenoble, France

[21] Appl. No.: 877,996

[22] Filed: Feb. 15, 1978

[30] Foreign Application Priority Data

Mar. 29, 1977 [FR] France ..... 77 10161

[51] Int. Cl.[2] ..... B22F 7/02

[52] U.S. Cl. ..... 428/548; 428/565; 252/515; 313/55; 313/330; 75/235; 75/176

[58] Field of Search ..... 75/176, 235; 252/515; 428/548, 565; 313/55, 330

[56] References Cited

U.S. PATENT DOCUMENTS 3,869,634 3/1975 Konieczynski et al. ..... 428/548

FOREIGN PATENT DOCUMENTS 1121407 7/1968 United Kingdom.

*Primary Examiner*—Benjamin R. Padgett
*Assistant Examiner*—E. Suzanne Parr
*Attorney, Agent, or Firm*—Dennison, Dennison, Meserole & Pollack

[57] ABSTRACT

A rotating anode for an x-ray tube, comprising a body of sintered, molybdenum-based alloy coated with a layer of tungsten or tungsten alloy at least in the zone of impact of the electrons. The molybdenum-based alloy contains from 3 to 10% by weight of tungsten and 0.01 to 0.5% of $ZrO_2$.

The anode has improved resistance to thermal stresses.

2 Claims, No Drawings

ROTATING ANODE FOR X-RAY TUBE

SUMMARY OF THE INVENTION

The invention concerns a rotating anode for x-ray tubes, comprising a body of sintered molybdenum-based alloy coated with a layer of tungsten or tungsten alloy in the zone of impact of the electrons.

By using molybdenum instead of tungsten to form the body of the anode it is possible to have higher rotational speeds, with a reduction in centrifugal forces due to the rotation of the anode, in view of the reduction in density. The large amount of heating observed in the zone of impact of the electrons causes deformation due to thermal stresses, thus shortening the life of the anodes.

Attempts have been made to increase the heat resistance of the basic molybdenum member by adding various substances. Thus, French Patent No. 1,496,294 proposes adding 0.5 to 1.5% by weight of titantium and 0.05 to 0.5% of zirconium to the molybdenum. It is also known that the addition of a certain quantity of tungsten to the molybdenum may have favorable effects on its hot properties.

Despite these various additions, the poor hot properties of the sintered alloys, i.e. their properties at about 1400° C., do not allow the life of the anodes to be greatly increased.

The purpose of the present invention is to limit deformations of the anode due to thermal stresses very considerably, by using a sintered, molybdenum-based alloy for the body, with mechanical properties far superior to those of alloys used in the past.

According to the invention, the body of the anode is made of sintered, molybdenum-based alloy containing by weight from 3 to 10% of tungsten and 0.01 to 0.5% of zirconia ($ZrO_2$).

Applicant has in fact discovered that at high temperature, i.e. between 1200° and 1500° C., the alloy has unexpected properties, which could not be foreseen from the mechanical properties of the molybdenum alloys used hitherto with a single addition of tungsten or zirconium.

As an example four grades of molybdenum alloy are compared on the basis of specimens which are sintered and welded with a welding rate of 65%:

A: pure Mo

B: Mo + 5.5% W

C: Mo + 0.4% $ZrO_2$

D: Mo + 5.5% W + 0.4% $ZrO_2$

Test pieces with a useful length of 20 mm and a diameter of 3 mm are made from these grade and subjected to traction tests under vacuum at 1400° C.

During the tests the temperature of the furnace is kept constant at ± 5° C. and pressure is kept between 2 and $4 \times 10^{-6}$ torr.

The traction speed is 0.1 mm/mn.

The results are as follows:

| Alloy | Yield Strength E – kg/mm² | Tensile Strength R – kg/mm² | Elongation A – % |
|---|---|---|---|
| A | 1.19 | 4.37 | 31.5 |
| B | 1.69 | 4.96 | 37.7 |
| C | 2.54 | 5.48 | 21.5 |
| D | 8.30 | 11.32 | 12.5 |

It will be seen that for grade D, which is according to the invention, the yield strength and tensile strength show considerably higher values than those obtained by adding simply tungsten or zirconia. There is thus a marked synergistic effect from adding both substances.

With this very considerable improvement in mechanical properties at 1400° C., anodes can be obtained with better resistance to thermal stresses and deformation in the vicinity of the zone of impact of the electrons.

I claim:

1. A rotating anode for an x-ray tube, comprising a body of sintered, molybdenum-based alloy coated with a layer of tungsten or tungsten alloy at least in the zone of impact of the electrons, wherein the coated molybdenum-based alloy contains by weight 3 to 10% of tungsten and 0.01 to 0.5% of zirconia.

2. A rotating anode as defined in claim 1, wherein the percentages by weight of the tungsten and zirconia are 5.5% and 0.4% respectively.

* * * * *